US007568712B2

(12) United States Patent
Kovachi et al.

(10) Patent No.: US 7,568,712 B2
(45) Date of Patent: Aug. 4, 2009

(54) HEIGHT AND WIDTH ADJUSTABLE SADDLE SLING SEAT WALKER WITH CONTROLLABLE DIRECTIONAL TRACKING AND OPTIONAL ARM SUPPORTS

(75) Inventors: Peter Kovachi, Tonawanda, NY (US); Joseph C. Mollendorf, Amherst, NY (US); Roger Teagarden, Lancaster, NY (US); Chee Main Heam, Perak (MY)

(73) Assignee: The Research Foundation of State University of NY, Amherst, NY (US)

( * ) Notice: Subject to any disclaimer, the term of this patent is extended or adjusted under 35 U.S.C. 154(b) by 303 days.

(21) Appl. No.: 11/594,687

(22) Filed: Nov. 8, 2006

(65) Prior Publication Data

US 2007/0107761 A1 May 17, 2007

Related U.S. Application Data

(60) Provisional application No. 60/735,160, filed on Nov. 9, 2005.

(51) Int. Cl.
*A61H 3/00* (2006.01)

(52) U.S. Cl. ..... 280/87.021; 280/87.03; 280/87.041; 280/87.05; 280/87.051; 280/23.1; 280/32.6; 280/87.1

(58) Field of Classification Search ..... 280/87.021, 280/87.03, 87.041, 87.05, 87.051, 23.1, 32.6, 280/87.1

See application file for complete search history.

(56) References Cited

U.S. PATENT DOCUMENTS

| | | | | | |
|---|---|---|---|---|---|
| 2,129,260 | A * | 9/1938 | Bowser | 297/6 |
| 4,272,071 | A * | 6/1981 | Bolton | 482/67 |
| 4,907,794 | A | 3/1990 | Rose | |
| 5,378,215 | A * | 1/1995 | Harkins | 482/67 |
| 5,476,432 | A * | 12/1995 | Dickens | 482/67 |
| 5,526,893 | A * | 6/1996 | Higer | 180/65.1 |
| 5,702,326 | A | 12/1997 | Renteria | |
| 5,800,318 | A * | 9/1998 | Coviello | 482/68 |
| 5,819,772 | A | 10/1998 | Pi | |
| 6,675,820 | B2 | 1/2004 | Balan | |
| 6,863,287 | B2 | 3/2005 | Myers et al. | |
| 6,921,101 | B1 | 7/2005 | Lauren et al. | |
| 7,275,554 | B2 * | 10/2007 | Mullholand | 135/67 |
| 2005/0183759 | A1 | 8/2005 | Wolfe | |

* cited by examiner

*Primary Examiner*—Christopher P Ellis
*Assistant Examiner*—Cynthia F Collado
(74) *Attorney, Agent, or Firm*—Simpson & Simpson, PLLC

(57) ABSTRACT

The invention relates to a walker having a main supporting frame, a superstructure frame and a body support means. The superstructure frame is operatively arranged for vertical adjustment relative to the main supporting frame and includes an adjustable interior opening for accommodating a user and an entrance gate operatively arranged to provide access to the adjustable interior opening. The body support means is secured to the superstructure frame and operatively arranged to support the user. Furthermore, the walker may include four wheels, each of which may include a directional locking apparatus and/or braking system, and the walker may include at least one arm support operatively arranged for supporting the user. The walker may also include at least one handle operatively arranged for transmission of the walker.

3 Claims, 6 Drawing Sheets

HEIGHT AND WIDTH ADJUSTABLE SADDLE SLING SEAT WALKER WITH CONTROLLABLE DIRECTIONAL TRACKING AND OPTIONAL ARM SUPPORTS

CROSS REFERENCE TO RELATED APPLICATION

This patent application claims the benefit under 35 U.S.C. §119(e) of U.S. Provisional Application No. 60/735,160, filed Nov. 9, 2005, which application is incorporated herein by reference.

STATEMENT REGARDING FEDERALLY SPONSORED RESEARCH

The United States Government has a paid-up license in this invention and the right in limited circumstances to require the patent owner to license others on reasonable terms as provided for by the terms of Grant No. BES-0436538 awarded by the National Science Foundation.

FIELD OF THE INVENTION

The present invention relates generally to rehabilitation devices, more specifically to rehabilitative walkers, and even more particularly to saddle sling seat walkers.

BACKGROUND OF INVENTION

Patients suffering from debilitating diseases and/or injuries often require rehabilitation in order to regain functionality in areas affected by their condition. Some rehabilitation techniques require that a patient utilize a walker to assist in supporting their body weight while they attempt to regain greater functionality of their legs and lower body. Rehabilitative walkers may take many forms including the traditional walkers designed to support a user while they stand and walk, as well as saddle sling seat walkers designed to support a user in a seated position while they use their legs for motive force.

Saddle sling seat walkers, also known as sling seat walkers, cradle a patient's body weight by using a sling which is secured to the walker frame and disposed between the patient's legs. Sling seat walkers provide necessary support for patients incapable of fully supporting their own body weight while walking. Sling seat walkers help patients walk that have reduced lower body strength and control. This type of walker provides many benefits to patients that use such walkers, e.g., increased blood circulation, reduction of bed sores, stronger bones and muscles, and a positive influence on mental and emotional states of being.

Sling seat walkers known in the art suffer from a variety of limitations. For example, only a select group of patients having the right combination of body size, strength and control can use existing sling seat walkers. Sling seat walkers offer height adjustment only and include small wheels that do not have brakes or directional locks, thereby making control of such walkers extremely difficult. Additionally, existing sling seat walkers do not offer any form of arm support and are not particularly user friendly for a patient or a therapist.

Prior sling seat walkers are difficult to use, require tools to make adjustments and occasionally cause injuries to patients that use them. For example, injuries from a vertical swinging entry bar are common. Additionally, wheels that are not large enough have a tendency to vibrate, roll and comer erratically under a patient's weight. These are not reassuring conditions for patients undergoing physical therapy. Furthermore, sling seat walkers having wheels without brakes create unsafe conditions during transfer of patients to and from their wheelchair and/or any time it is necessary to maintain the walker in a stationary position. Additionally, sling seat walkers without directional locking apparatus lack control of tracking and directionality.

At times, patients may lack the ability to fully support their own upper body weight. Thus, when using a sling seat walker without arm supports, some patients lose control of their upright body posture and therefore they cannot use this type of walker. Similarly, existing sling seat walkers lack features which permit therapists to manipulate the walkers, e.g., handles.

Accordingly, there has been a long-felt need for a sling seat walker having length, width and height adjustability, wheel brakes, wheel directional locks and arm supports, while remaining user friendly for both the patient and therapist.

SUMMARY OF INVENTION

It is therefore a principal object of the invention to provide a walker having convenient means for adjusting length, width and height of the walker, thereby permitting the walker to be modified to accommodate users of various body types, size and conditions. Yet another principal object of the invention is to provide a walker which enables people with limited leg strength to be in a standing position and/or to walk.

Another object of the invention is to provide a walker having wheels which include a brake system and/or directional locks.

Still a further object of the invention is to provide a sling seat walker having at least one arm support, while yet another object is to provide a walker having means for transmission of the walker by a therapist or user.

Thus in view of the foregoing, the present invention broadly comprises a walker having a main supporting frame and a superstructure frame operatively arranged for vertical adjustment relative to the main supporting frame, the superstructure frame includes an adjustable interior opening for accommodating a user and an entrance gate operatively arranged to provide access to the interior opening. The walker may include a body support means secured to the superstructure frame and operatively arranged to support the user. In one embodiment, the body support means is releasably secured to the superstructure frame, while in another embodiment the superstructure frame includes a generally rectangular configuration. One aspect of the invention is that the main supporting frame creates a first cross-sectional area when viewed from above and the superstructure frame creates a second cross-sectional area when viewed from above and the first cross-sectional area may be dimensionally greater than the second cross-sectional area. Another aspect of the present invention walker is that the main supporting frame may define an area which is sufficiently open to allow movement of the user's legs. In yet another embodiment, the walker includes at least one handle operatively arranged for transmission of the walker.

In a further embodiment, the adjustable interior opening includes front and rear horizontal bars each having first and second ends and first and second horizontally adjustable side bars. In this embodiment, the first horizontally adjustable side bar is fixedly secured to the first end of the front horizontal bar and the first end of the rear horizontal bar, the second horizontally adjustable side bar is fixedly secured to the second end of the front horizontal bar and the second end of the rear horizontal bar, and each of the first and second horizontally adjustable side bars is operatively arranged for horizontal adjustment of the rear horizontal bar relative to the front horizontal bar. In still a further embodiment, the adjustable interior opening includes third and fourth horizontally adjustable side bars. In this embodiment, the third horizontally adjustable side bar is slideably connected to the first end of the front horizontal bar and the first end of the rear horizontal bar, the fourth horizontally adjustable side bar is slideably connected to the second end of the front horizontal bar and the second end of the rear horizontal bar, and each of the third and fourth horizontally adjustable side bars is operatively arranged for horizontal adjustment relative to the first and second horizontally adjustable side bars. And in yet a further embodiment, the adjustable interior opening includes front and rear horizontal bars each having first and second ends and third and fourth horizontally adjustable side bars. In this further embodiment, the third horizontally adjustable side bar is slideably connected to the first end of the front horizontal bar and the first end of the rear horizontal bar, the fourth horizontally adjustable side bar is slideably connected to the second end of the front horizontal bar and the second end of the rear horizontal bar, and the third and fourth horizontally adjustable side bars are operatively arranged for horizontal adjustment relative to the fourth and third horizontally adjustable side bars, respectively.

In another embodiment, the present invention walker further includes first and second front wheels and first and second rear wheels. In yet other embodiments, the first and second front wheels each include a directional locking apparatus, the first and second rear wheels each include a directional locking apparatus or the first and second front wheels and said first and second rear wheels each include a directional locking apparatus. In a further embodiment, at least one of the first and second front wheels and the first and second rear wheels include a braking system.

In yet another embodiment, the walker includes at least one removable arm support operatively arranged for supporting the user. In one embodiment, the at least one removable arm support is operatively arranged for vertical adjustment relative to the main supporting frame, while in another embodiment, the at least one removable arm support is operatively arranged for pivotal movement, and in yet another embodiment, the at least one removable arm support is operatively arranged for vertical adjustment relative to the main supporting frame and for pivotal movement.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred embodiments, it is to be understood that the invention as claimed is not limited to the disclosed embodiments.

Furthermore, it is understood that this invention is not limited to the particular methodology, materials and modifications described and as such may, of course, vary. It is also understood that the terminology used herein is for the purpose of describing particular embodiments only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
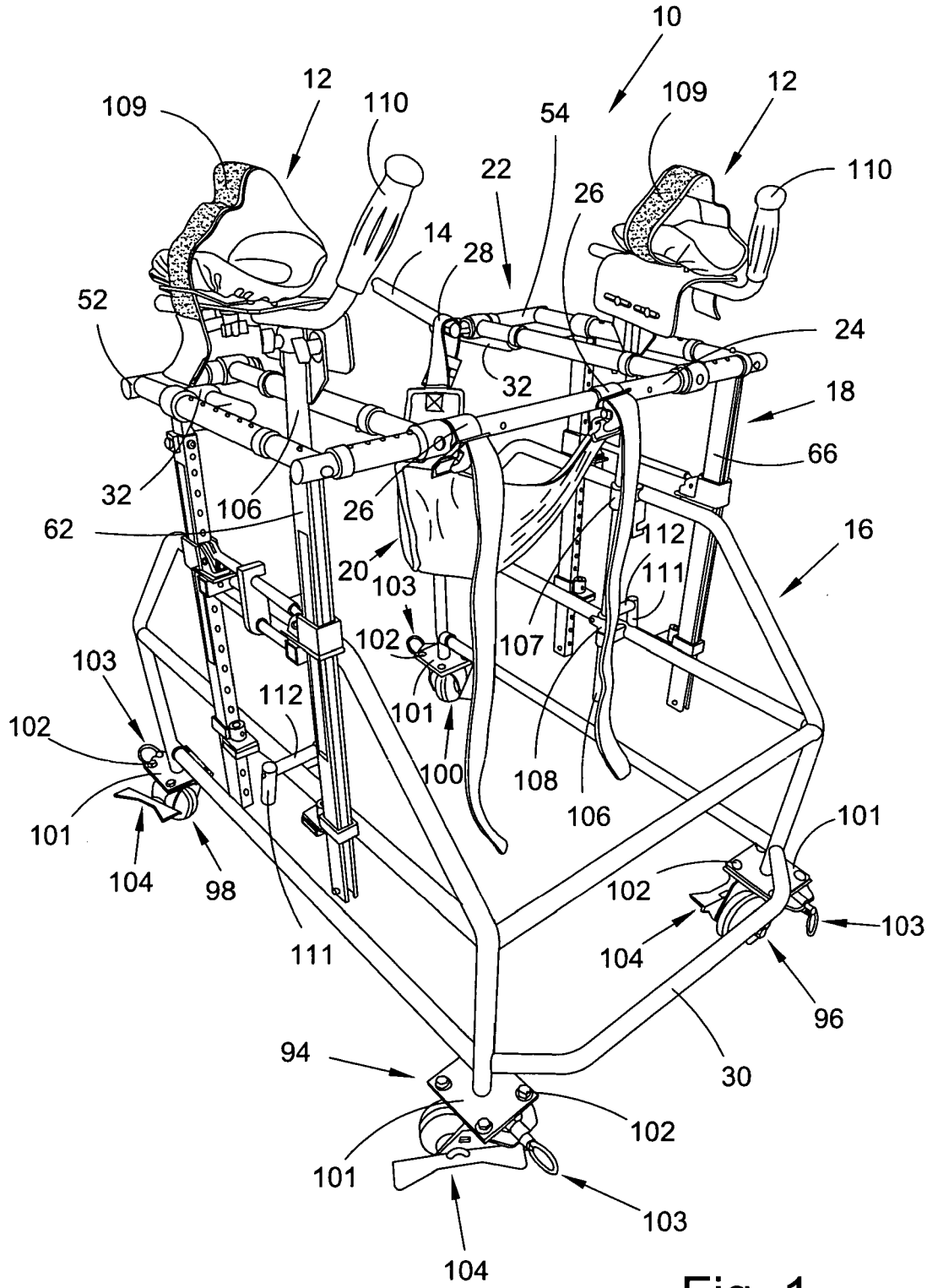
FIG. 1 is a front perspective view of a present invention sling seat walker having arm supports and an entrance gate in an open position.

Adverting now to the figures, FIG. 1 is a front perspective view of the present invention walker 10 having arm supports 12 and entrance gate 14. Walker 10 broadly comprises main supporting frame 16, superstructure frame 18 and body support means 20. In the embodiments shown in the figures, main supporting frame 16 is constructed from one inch outer diameter, eighth (⅛) inch thick crew tube steel. As one of ordinary skill in the art will appreciate, other construction materials may also be used, e.g., tubing having a square cross-section, and such variations are within the spirit and scope of the invention. Main supporting frame 16 includes three sides, i.e., front, left and right and the back is left open to permit a user to enter and exit walker 10. Superstructure frame 18 is operatively arranged for vertical adjustment relative to main supporting frame 16. Superstructure frame 18 further includes adjustable interior opening 22 for accommodating a user (not shown) and entrance gate 14 operatively arranged to provide access to interior opening 22. Body support means 20 is secured to superstructure frame 18 and operatively arranged to support the user. In one embodiment, body support means 20 is releasably secured to front horizontal bar 24 of superstructure frame 18 via straps 26. Additionally, body support means 20 is releasably secured to entrance gate 14 via strap 28. Although the embodiments shown in the figures, depict superstructure frame 18 as a generally rectangular configuration, one of ordinary skill in the art will appreciate that other configurations are possible, and such configurations are within the spirit and scope of the claims.

Figure 2:
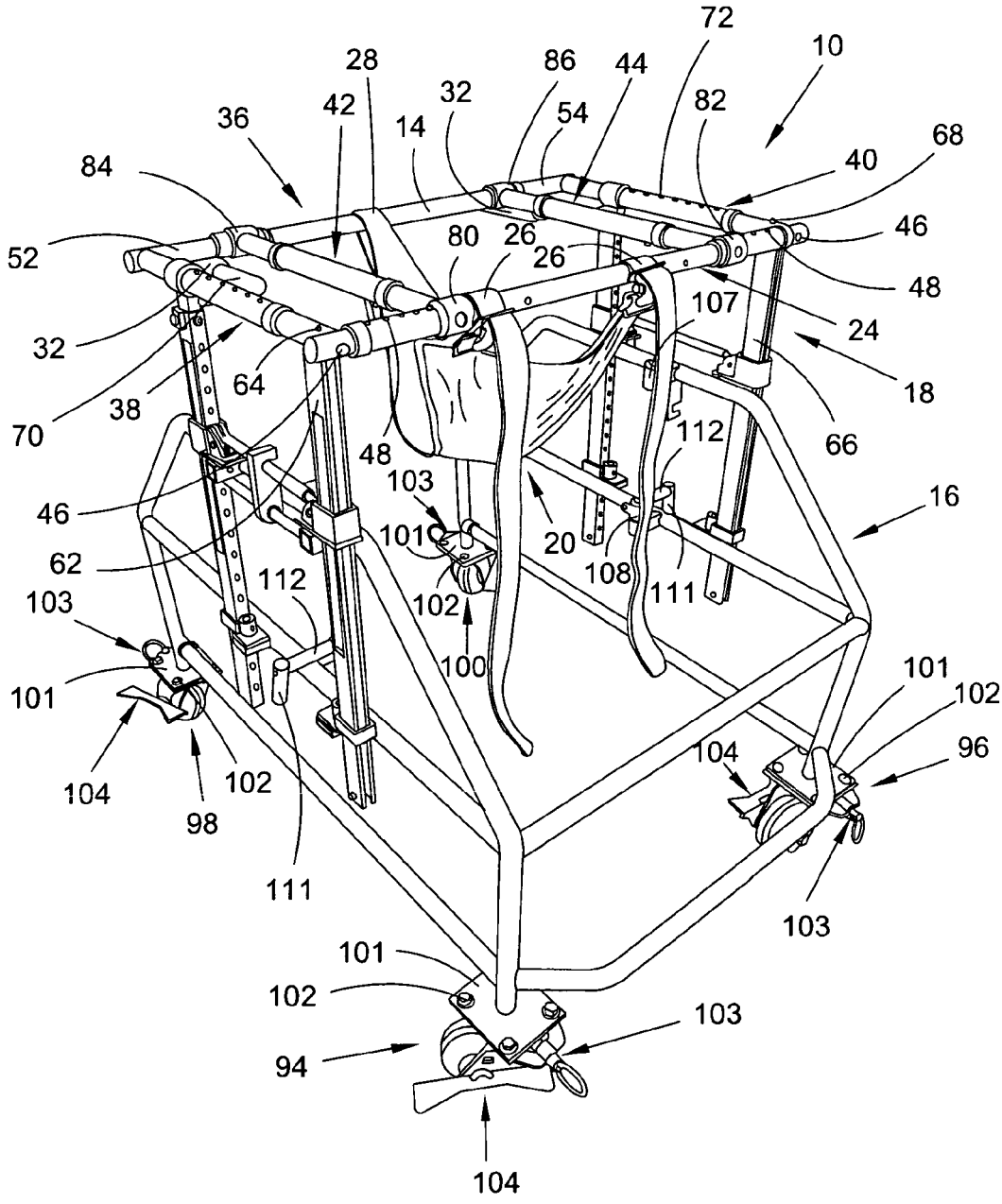
FIG. 2 is a front perspective view of a present invention sling seat walker without arm supports and having an entrance gate in a closed position.

FIG. 2 is a front perspective view of walker 10 without arm supports 12 and having entrance gate 14 in a closed position. As can be seen in FIGS. 1 and 2, the footprint created by main supporting frame 16 is larger than the footprint created by superstructure frame 18, when both are viewed from above. Thus, main supporting frame 16 provides added stability to the assembly by effectively lowering walker 10's center of gravity. Additionally, main supporting frame 16 includes features to provide added open space so that a user's legs will be free to move, without impediment by main supporting frame 16. An example of such features is the expanded space created by front horizontal bar 30.

In the embodiments shown in the figures, walker 10 further includes handles 32 operatively arranged for transmission of walker 10. Although, in these embodiments, two handles 32 are shown, one of ordinary skill in the art will appreciate that other configurations are possible, for example, a single handle arranged on entrance gate 14, and such variations are within the spirit and scope of the claimed invention.

Figure 3:
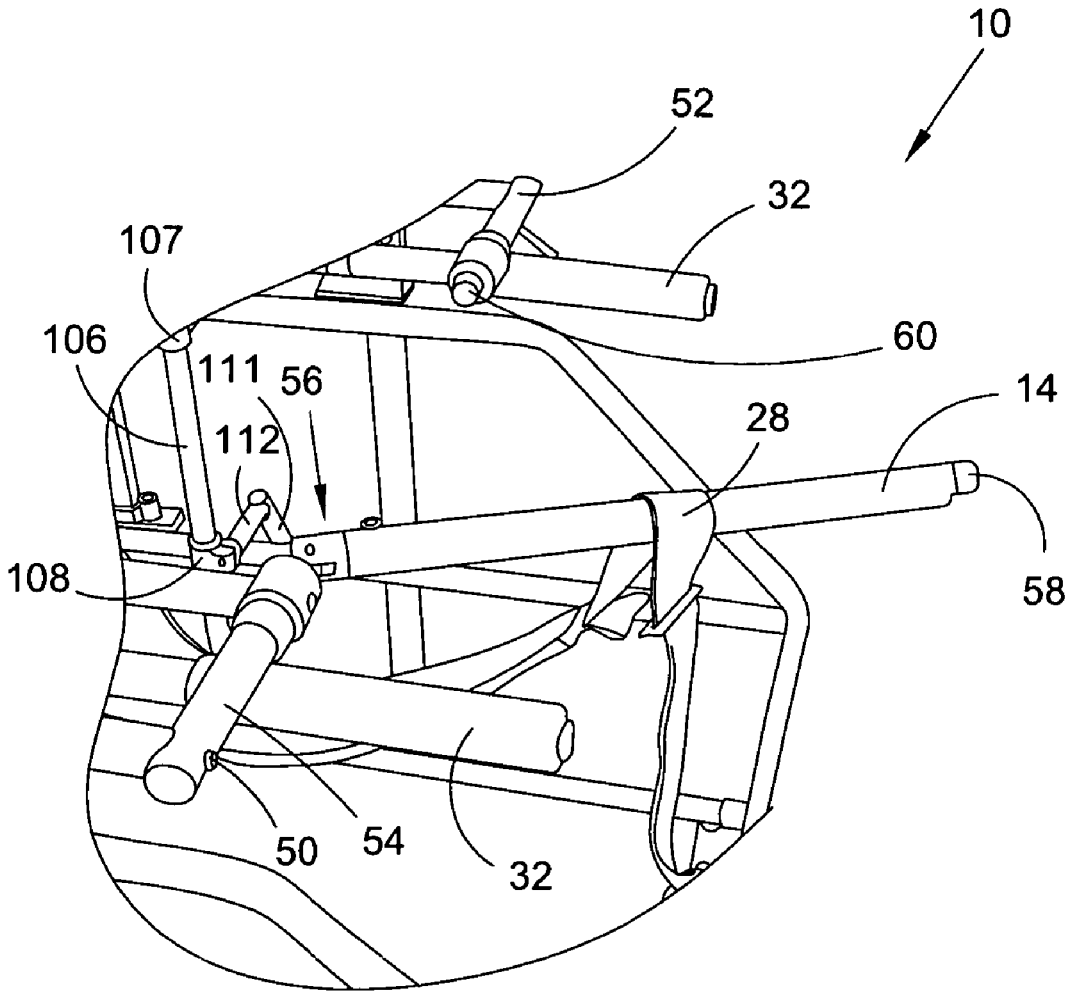
FIG. 3 is a partial rear perspective view of a portion of a present invention sling seat walker showing an entrance gate in an open position.
Figure 4:
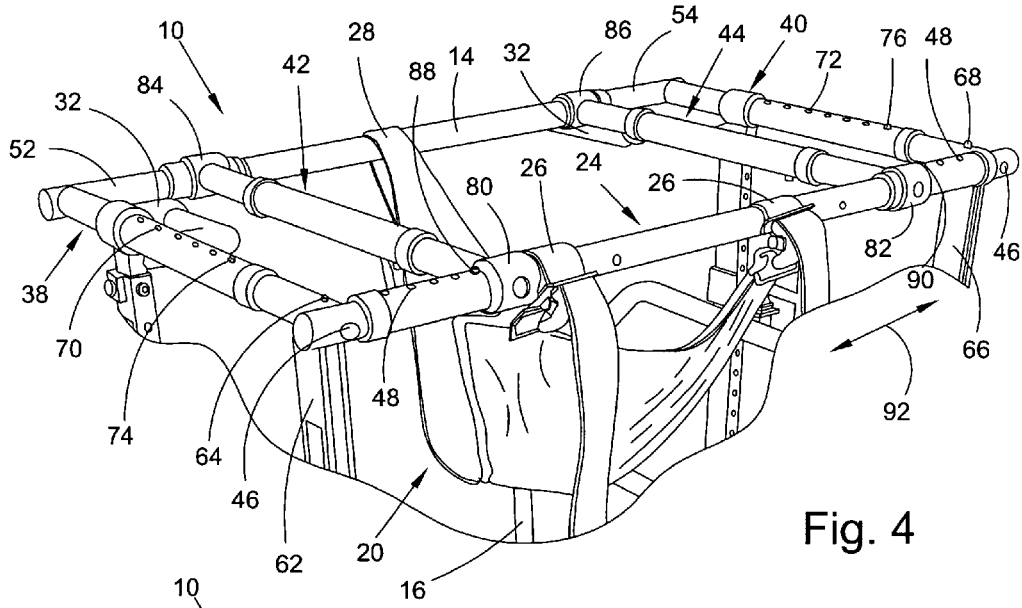
FIG. 4 is a partial front perspective view of a present invention sling seat walker without arm supports showing an entrance gate in a closed position.
Figure 5:
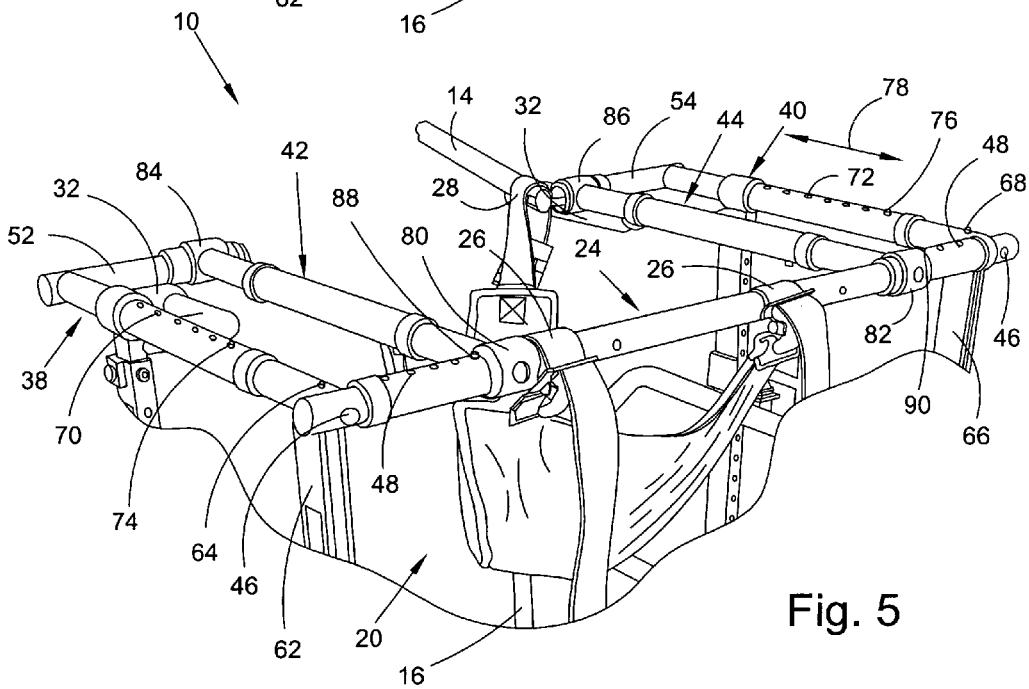
FIG. 5 is a partial front perspective view of a present invention sling seat walker without arm supports showing an entrance gate in an open position.

FIG. 3 is a partial rear perspective view of a portion of walker 10 showing entrance gate 14 in an open position, FIG. 4 is a partial front perspective view of walker 10 without arm supports 12 and showing entrance gate 14 in a closed position, and FIG. 5 is a partial front perspective view of walker 10 without arm supports 12 and showing entrance gate 14 in an open position. The following is best understood in view of FIGS. 1 through 5.

As described supra, superstructure frame 18 includes adjustable interior opening 22. Adjustable interior opening 22 further includes a plurality of horizontal and horizontally adjustable bars. In the embodiments shown in the figures, superstructure frame 18 includes front and rear horizontal bars 24 and 36, respectively, left and right horizontally adjustable outer side bars 38 and 40, respectively, and left and right horizontally adjustable inner side bars 42 and 44, respectively. Front horizontal bar 24 is fixedly secured to each of left and right horizontally adjustable outer side bars 38 and 40, respectively, via fasteners 46 and includes a plurality of locating holes 48 proximate each end of front horizontal bar 24. Rear horizontal bar 36 is fixedly secured to each of left and right horizontally adjustable outer side bars 38 and 40, respectively, via fasteners 50 and includes entrance gate 14. As can be seen in the figures, rear horizontal bar 36 is not a continuous structure, but perhaps better described as having three parts, left and right portions 52 and 54, respectively, and entrance gate 14. Entrance gate 14 is pivotally secured to right portion 54 via hinge 56. Hinge 56 is arranged so that entrance gate 14 may be opened to an angle which permits a user to enter adjustable interior opening 22 unimpeded. Furthermore, entrance gate 14 is maintained in a closed position by the engagement of locking feature 58 within locking mechanism 60. In the embodiments shown in the figures, locking feature 58 is a rotating slide lock, however it is within the spirit and scope of the claimed invention to use other locking means, e.g., snap locks. When entrance gate 14 is in an open position (See FIGS. 1, 3 and 5), a user may enter adjustable interior opening 22 and be positioned on body support means 20. In some embodiments, the open portion of main supporting frame 16, i.e., the portion accessed via entrance gate 14, is sufficiently wide to allow a standard wheelchair to be rolled into the opening. Thus, a user entering from a wheelchair is easily accommodated within body support means 20, and it allows for easier and safer transition from the wheelchair.

Left horizontally adjustable outer side bar 38 is fixedly secured to first vertical adjustment bar 62 by fastener 64, while right horizontally adjustable outer side bar 40 is fixedly secured to second vertical adjustment bar 66 by fastener 68. Both left and right horizontally adjustable outer side bars 38 and 40, respectively, include a plurality of positioning holes 70 and 72, respectively, and positional locking means 74 and 76, respectively. Although in the embodiments shown in the figures, positional locking means 74 and 76 are push button releases, other locking means are also within the spirit and scope of the claims, e.g., spring loaded flanges. By depressing positional locking means 74 and 76, rear horizontal bar 36 may be moved horizontally relative to front horizontal bar 24, i.e., in the directions shown by bi-directional arrow 78. Thus, adjustable interior opening 22 may be modified to accommodate a user who requires a larger or smaller open space within adjustable interior opening 22. As can be seen in the figures, left and right horizontally adjustable inner side bars 42 and 44, respectively, are also arranged to permit horizontal adjustment of rear horizontal bar 36 relative to front horizontal bar 24, however, in the embodiment shown, no locking means are provided on either left and right horizontally adjustable inner side bars 42 and 44, respectively. Thus, both left and right horizontally adjustable inner side bars 42 and 44, respectively, are free to expand and contract longitudinally, i.e., in the directions shown by bi-directional arrow 78.

Left and right horizontally adjustable inner side bars 42 and 44, respectively, are slideably connected to front horizontal bar 24 with first and second collars 80 and 82, respectively. Similarly, left and right horizontally adjustable inner side bars 42 and 44, respectively, are slideably connected to rear horizontal bar 26 with third and fourth collars 84 and 86, respectively. As described supra, front horizontal bar 24 includes a plurality of locating holes 48 proximate each end, which is also proximate the locations where collars 80 and 82 connect to front horizontal bar 24. Positional locking means 88 and 90 are operatively arranged to maintain the position of left and right horizontally adjustable inner side bars 42 and 44, respectively. Additionally, by depressing positional locking means 88 and 90, left and right horizontally adjustable inner side bars 42 and 44, respectively, may be moved horizontally relative to left and right horizontally adjustable outer side bars 38 and 40, respectively, i.e., in the directions shown by bi-directional arrow 92. Thus, adjustable interior opening 22 may be modified to accommodate a user who requires a larger or smaller open space within adjustable interior opening 22.

Although in the embodiments shown in the figures, adjustable interior opening 22 may be modified to accommodate a user in the directions shown by both bi-directional arrows 78 and 92, one of ordinary skill in the art will recognize that modification in the directions shown by only one of arrows 78 or 92 is also possible. In other words, adjustable interior opening 22 may be modified to accommodate various users in one axis, e.g., bi-directional arrow 78 or 92, or in two axes, e.g., bi-directional arrow 78 and 92, and such variations are within the spirit and scope of the claimed invention.

Figure 6:
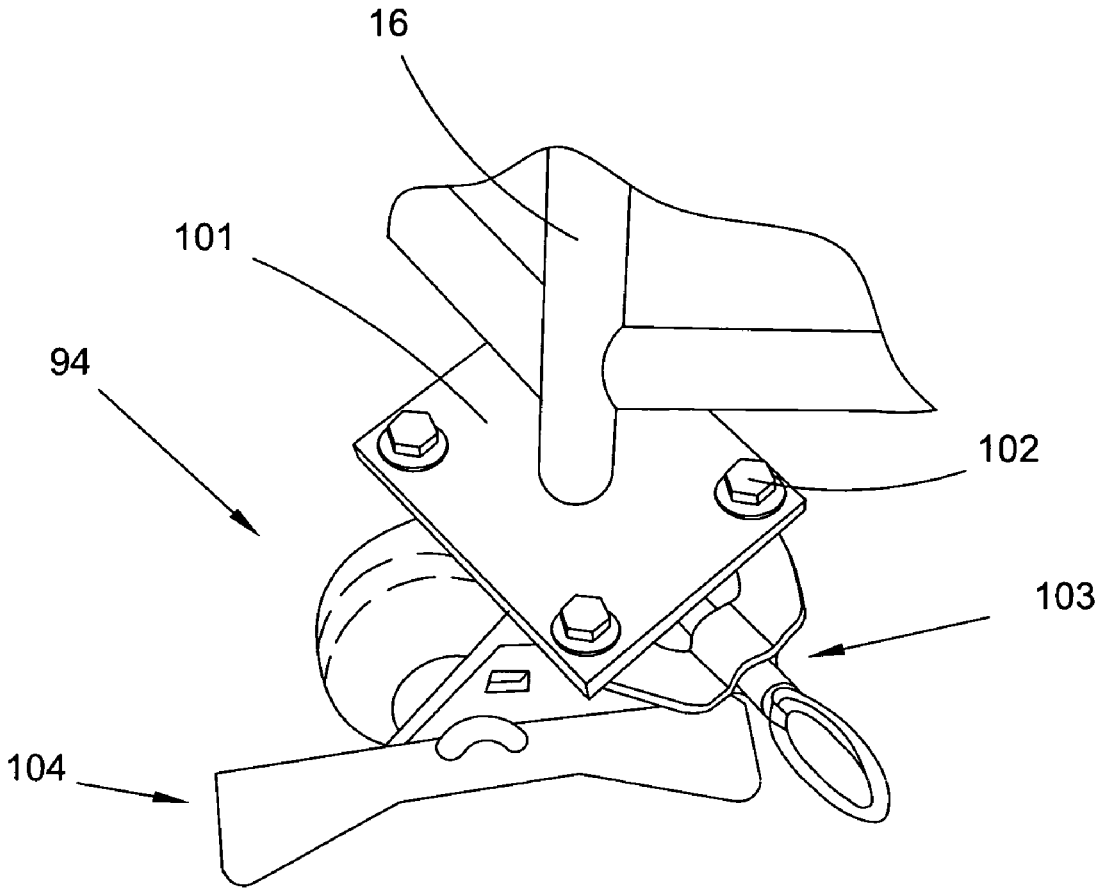
FIG. 6 is a partial top perspective view of a present invention sling seat walker wheel having a brake system and directional locking means; and, FIG. 7 is a partial front perspective view of a present invention sling seat walker showing an embodiment of a vertical adjustment system.

FIG. 6 shows a partial top perspective view of wheel 94 of walker 10. The following is best understood in view of FIGS. 1, 2 and 6. Walker 10 may further include first and second front wheels 94 and 96, respectively, and first and second rear wheels 98 and 100, respectively. Wheels 94, 96, 98 and 100 are connected to walker 10 via plates 101 and are provided to permit transmission of walker 10 by either a user or a therapist assisting a user, and are selected for use on a variety of surfaces, e.g., wood, concrete, carpeting, etc. Plates 101 are welded to main supporting frame 16 and subsequently wheels 94, 96, 98 and 100 are fixedly secured to plates 101 via fasteners 102. Wheels 94, 96, 98 and 100, for example, may be non-marring surface castors capable of carrying 500 pounds each. Although castors are typically capable of swiveling a full 360°, this ability is not always desirably for a user of walker 10. Thus, in the embodiments shown in the figures, wheels 94, 96, 98 and 100 each include directional locking means 103. It has been found that several different combinations of locking means 103 are beneficial for users and therapists. For example, walker 10 may be arranged for full mobility, limited mobility or straight line mobility. In a full mobility arrangement, no locking means 103 are engaged and therefore wheels 94, 96, 98 and 100 are free to rotate 360°. In a limited mobility arrangement, either locking means 103 of wheels 94 and 96 are engaged or locking means 103 of wheels 98 and 100 are engaged. In such arrangements, rotation of either the front wheel set or the rear wheel set is prevented while the complimentary wheel set is free to rotate. In other words, two wheels are directionally locked forward/backward and two wheels are free to rotate 360° thereby assisting the user and/or therapist to maintain some directional mobility. A straight line mobility arrangement consists of all locking means 103 of wheels 94, 96, 98 and 100 being engaged. In this arrangement, walker 10 will only permit forward and backward mobility and thus prevent users and/or therapists from veering left or right, and for example, striking a wall.

Wheels 94, 96, 98 and 100 may further include at least one braking system. For example, in the embodiments shown in the figures, wheels 94, 96, 98 and 100 each include braking device 104. One, several or all braking devices 104 may be engaged thereby preventing any movement of walker 10. Thus, a user and/or therapist may maintain the position of walker 10 without expending any effort other than engaging braking device 104. This feature is particularly helpful when a user is entering and exiting walker 10 as movement of walker 10 during those actions would increase the likely of injury.

As one of ordinary skill in the art appreciates, the embodiments of directional locking means 103 and braking devices 104 shown in the figures are not the only means by which directional mobility and movement may be limited, and such variations are within the spirit and scope of the claims. For example, directional locking and braking systems may be hand actuated systems wherein the hand actuation device is arranged on arm supports 12, i.e., analogous to braking systems common to bicycles.

Often, users of devices similar to walker 10 are not capable of supporting their own body weight without assistance. Thus, some embodiments of walker 10 incorporate arm supports 12 arranged to support a user in a substantially upright position. Similar to adjustable interior opening 22, arm supports 12 must be capable of being configured for a variety of user characteristics, e.g., seated height and arm length. Thus, arm supports 12 are each mounted on shaft 106, which in turn is disposed within follower collar 107 and locking collar 108. Follower collar 107 is fixedly secured to main supporting frame 16 and arranged to prevent rocking movement of shaft 106, while locking collar 108 is also fixedly secured to main supporting frame 16 and arranged to releasably secure shaft 106, and thereby arm supports 12, to main supporting frame 16. Thus, according to the embodiments shown in the figures, arm support 12 may be pivoted and/or raised/lowered to a desired position, i.e., the most comfortable position given a user's physical characteristics and needs. In the embodiments shown in the figures, arm supports 12 have further degrees of freedom, e.g., arm support 12 relative to shaft 106, and include straps 109 and handles 110, however these features are not particularly germane to the invention, and therefore are not discussed. Handle 111 is pivotally secured to locking collar 108 by shaft 112. When handle 111 is rotated, locking collar 108 expands or contracts, depending on the direction of rotation, thereby releasing or engaging shaft 106 within locking collar 108. It should be appreciated that walker 10 may or may not include arm supports 12, as this depends on the user's needs, and thus both embodiments are within the spirit and scope of the claims. Additionally, other locking means are also possible, e.g., a locking pin engaging holes along shaft 106 (not shown). Furthermore, arm supports 12 may also be releasably secured to superstructure frame 18 instead of or in combination with main supporting frame 16.

Figure 7:
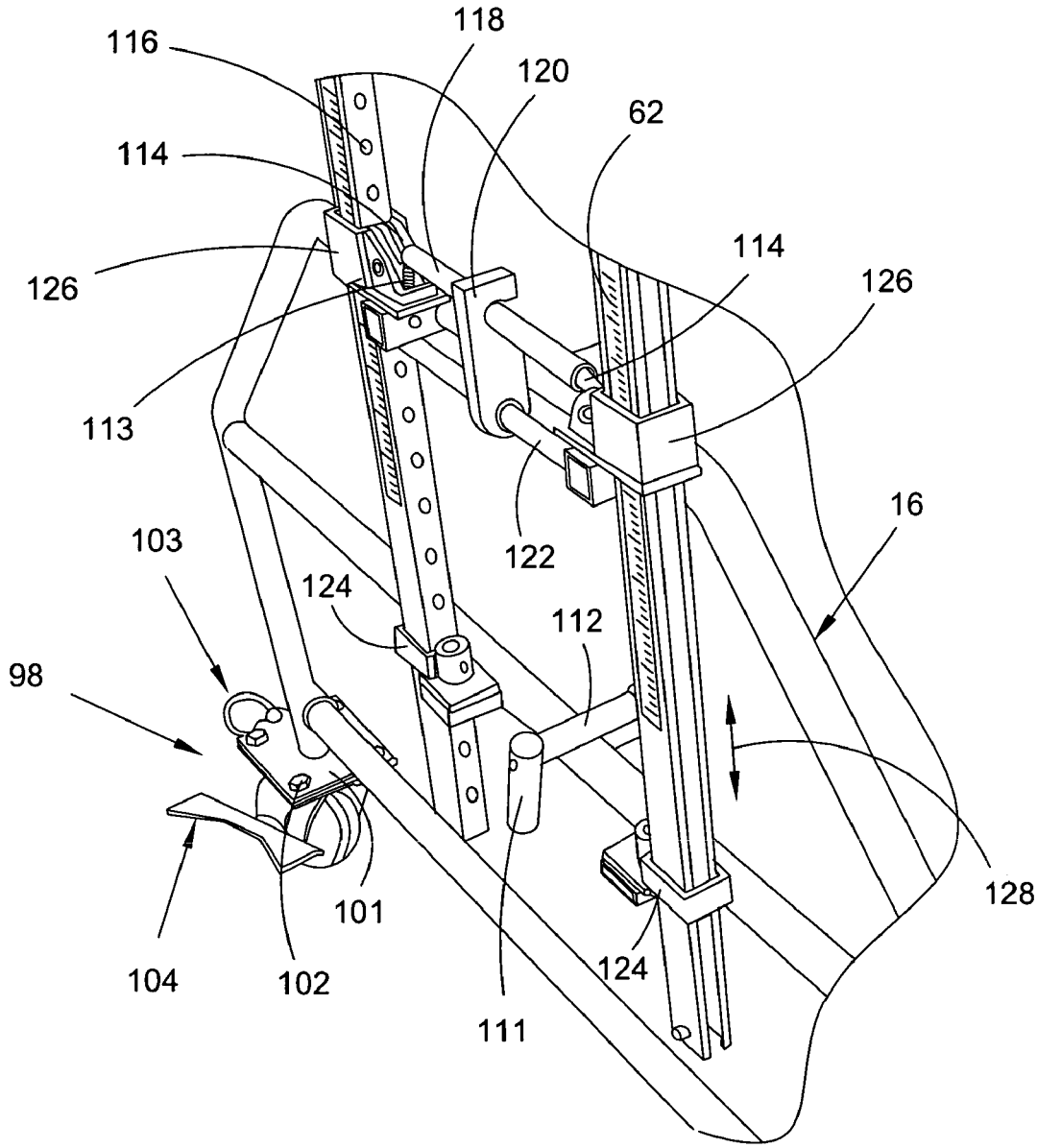

FIG. 7 is a partial front perspective view of walker 10 showing an embodiment of a vertical adjustment system. In the embodiments shown in the figures, vertical adjustments are made via four pipe-style clamps. More specifically, the embodiment includes springs 113 which load rotating locks 114 thereby engaging locks 114 within one of the plurality of indentations 116. Due to the tapered shape of each of the plurality of indentations 116, there is no resistance when lifting up superstructure frame 18, however downward movement requires release of rotating locks 114 by applying a downward force to release bar 118. As can be appreciated in view of FIG. 7, in order to move release bar 118 downward, safety lock 120 must be rotated away from release bar 118, thereby permitting movement of release bar 118. Thus, after safety lock 120 has been rotated out of its engaged position, i.e., the position shown in FIG. 7, release bar 118 can be moved by gripping release bar 118 and fixed bar 122 together. Subsequent to releasing rotating locks 114, an upward force may be applied to superstructure frame 18 until it reaches the desired height at which time release bar 118 is restored to its engaged position via the force imparted by springs 113 through rotating locks 114. Alternatively, safety lock 120 may be rotated out of its engaged position and after gripping release bar 118 and fixed bar 122 together, a downward force applied to superstructure frame 18, thereby lowering frame 18 to a desired height. Subsequent to either upward or downward movement, safety lock 120 can be restored to its engaged position to prevent any further vertical movement of superstructure frame 18. Collars 124 and 126 are included to limit the directions which superstructure frame 18 may move. Thus, according to the embodiments shown in the figures, superstructure frame 18 can move in the directions defined by bi-directional arrow 128.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed is:

1. A walker comprising:

a main supporting frame;

a superstructure frame operatively arranged for vertical adjustment relative to said main supporting frame, said superstructure frame comprising an adjustable interior opening for accommodating a user and an entrance gate operatively arranged to provide access to said adjustable interior opening;

a body support means secured to said superstructure frame and operatively arranged to support said user;

front and rear horizontal bars each having first and second ends;

first and second horizontally adjustable side bars; and, third and fourth horizontally adjustable side bars, wherein said first horizontally adjustable side bar is fixedly secured to said first end of said front horizontal bar and said first end of said rear horizontal bar, said second horizontally adjustable side bar fixedly secured to said second end of said front horizontal bar and said second end of said rear horizontal bar, each of said first and second horizontally adjustable side bars operatively arranged for horizontal adjustment of said rear horizontal bar relative to said front horizontal bar, said third horizontally adjustable side bar is slideably connected to said first end of said front horizontal bar and said first end of said rear horizontal bar, said fourth horizontally adjustable side bar slideably connected to said second end of said front horizontal bar and said second end of said rear horizontal bar, and each of said third and fourth horizontally adjustable side bars operatively arranged for horizontal adjustment relative to said first and second horizontally adjustable side bars.

2. A walker comprising:

a main supporting frame;

a superstructure frame operatively arranged for vertical adjustment relative to said main supporting frame, said superstructure frame comprising an adjustable interior opening for accommodating a user and an entrance gate operatively arranged to provide access to said adjustable interior opening;

a body support means secured to said superstructure frame and operatively arranged to support said user;

front and rear horizontal bars each having first and second ends; and, third and fourth horizontally adjustable side bars, wherein said third horizontally adjustable side bar is slideably connected to said first end of said front horizontal bar and said first end of said rear horizontal bar, said fourth horizontally adjustable side bar slideably connected to said second end of said front horizontal bar and said second end of said rear horizontal bar, and said third and fourth horizontally adjustable side bars operatively arranged for horizontal adjustment relative to said fourth and third horizontally adjustable side bars, respectively.

3. An adjustable frame for a walker comprising:

an adjustable interior opening for accommodating a user and an entrance gate operatively arranged to provide access to said adjustable interior opening, said adjustable interior opening comprising front and rear horizontal bars each having first and second ends, first, second, third and fourth horizontally adjustable side bars wherein said first horizontally adjustable side bar is fixedly secured to said first end of said front horizontal bar and said first end of said rear horizontal bar, said second horizontally adjustable side bar fixedly secured to said second end of said front horizontal bar and said second end of said rear horizontal bar, and each of said first and second horizontally adjustable side bars operatively arranged for horizontal adjustment of said rear horizontal bar relative to said front horizontal bar and wherein said third horizontally adjustable side bar is slideably connected to said first end of said front horizontal bar and said first end of said rear horizontal bar, said fourth horizontally adjustable side bar slideably connected to said second end of said front horizontal bar and said second end of said rear horizontal bar, and each of said third and fourth horizontally adjustable side bars operatively arranged for horizontal adjustment relative to said first and second horizontally adjustable side bars.

* * * * *